United States Patent [19]

Carmein

[11] Patent Number: 5,056,381

[45] Date of Patent: Oct. 15, 1991

[54] REPLACEMENT TOOL HANDLE, HAND TOOL AND METHOD

[76] Inventor: Joseph A. Carmein, 525 N. Maple Dr., Beverly Hills, Calif. 90210

[21] Appl. No.: 487,420

[22] Filed: Mar. 1, 1990

Related U.S. Application Data

[63] Continuation-in-part of Ser. No. 486,440, Feb. 28, 1990, Pat. No. 5,031,272.

[51] Int. Cl.[5] ..... B21K 5/00; B25D 1/00

[52] U.S. Cl. ..... 76/103; 16/110 R; 81/20

[58] Field of Search ..... 16/110 R; 81/20; 76/103, 109

[56] References Cited

U.S. PATENT DOCUMENTS

| | | | |
|---|---|---|---|
| 404,663 | 6/1889 | Thompson et al. . | |
| 894,155 | 7/1908 | Layton . | |
| 1,435,851 | 11/1922 | Isham . | |
| 2,205,769 | 6/1940 | Sweetland . | |
| 2,837,381 | 6/1958 | Sarlandt . | |
| 2,850,331 | 9/1958 | Curry et al. . | |
| 3,753,602 | 8/1973 | Carmien . | |
| 3,819,288 | 6/1974 | Carmien . | |
| 3,874,433 | 4/1975 | Shepherd, Jr. et al. . | |
| 3,877,826 | 4/1975 | Shepherd, Jr. et al. . | |
| 3,915,782 | 10/1975 | Davis et al. | 16/110 R |
| 3,917,421 | 11/1975 | Carmien et al. . | |
| 4,030,847 | 6/1977 | Carmien . | |
| 4,085,784 | 4/1978 | Fish . | |
| 4,139,930 | 2/1979 | Cox . | |
| 4,287,640 | 9/1981 | Keathley . | |
| 4,291,998 | 9/1981 | Santos . | |
| 4,367,979 | 1/1983 | Carmien . | |
| 4,404,708 | 9/1983 | Winter . | |

FOREIGN PATENT DOCUMENTS

| | | | |
|---|---|---|---|
| 1064418 | 5/1954 | France | 81/20 |

*Primary Examiner*—Robert L. Spruill
*Assistant Examiner*—Carmine Cuda
*Attorney, Agent, or Firm*—Kelly, Bauersfeld & Lowry

[57] ABSTRACT

A replacement tool handle for a percussive tool includes a high strength, load-bearing rod which is inserted through the eyehole of a tool head from its upper end, a grip which ensheathes a portion of the rod projecting from a lower end of the tool head, and two interlocking members which fasten the grip to the rod. The rod includes a handle shaft capable of passing completely through the eyehole of the tool head, and a shaft retainer located at a first end of the shaft for preventing an adjacent end of the rod from passing through the eyehole. The shaft retainer forms a generally frustoconical slug having an outer surface portion generally corresponding to a portion of the eyehole, an enlarged portion which is incapable of passing through the eyehole, and an inner cavity in which the first end of the shaft is secured. Both the handle shaft and an internal cavity provided the grip have non-circular cross-sections to prevent turning of the grip relative to the shaft. The interlocking members each include tooth portions which engage one another within the outer periphery of the handle in a manner which denies access to a user, thus ensuring a permanent connection.

27 Claims, 2 Drawing Sheets

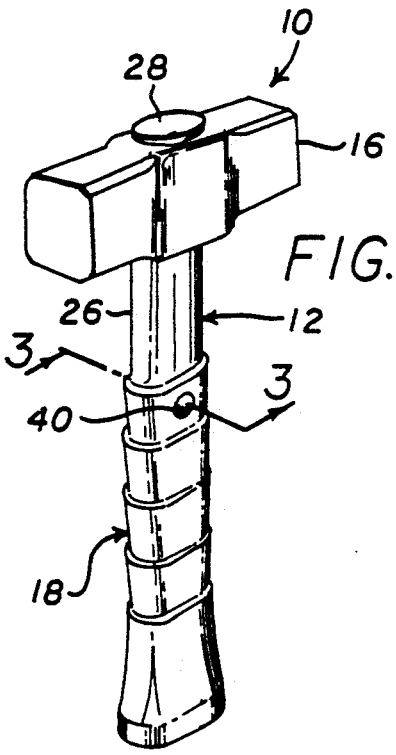
FIG. 1
FIG. 2
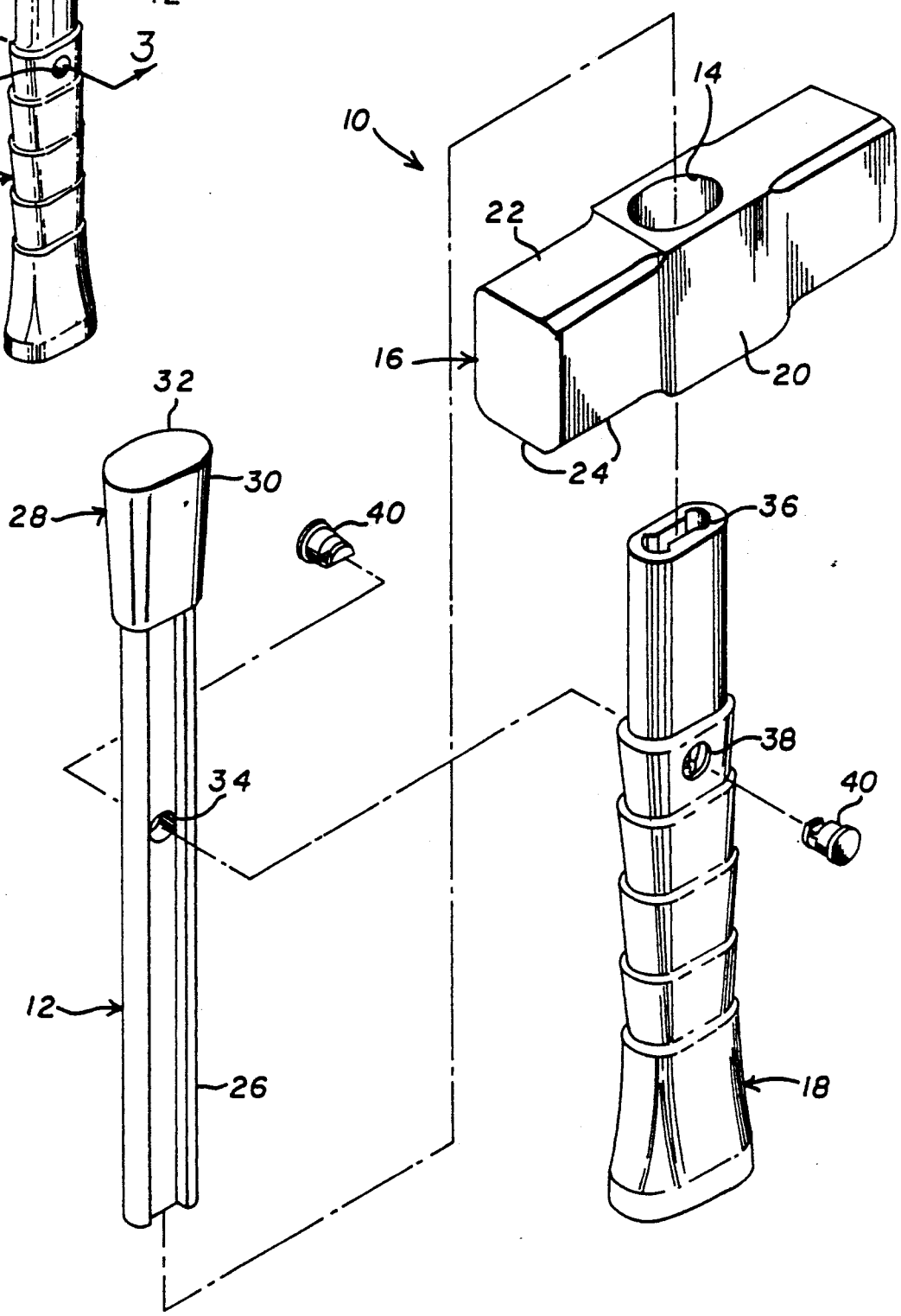

REPLACEMENT TOOL HANDLE, HAND TOOL AND METHOD

RELATED APPLICATION

This application is a continuation-in-part of U.S. patent application Ser. No. 07/486,440, filed Feb. 28, 1990, and entitled TOOL HANDLE AND METHOD OF ATTACHING A HANDLE TO A PERCUSSIVE TOOL HEAD, now U.S. Pat. No. 5,031,272. The contents of that application are incorporated herein by reference.

BACKGROUND OF THE INVENTION

This invention relates generally to hand tools. More particularly, the present invention relates to an improved composite handle and means for attaching the handle to the heads of tools such as hammers, hatchets, axes and the like, in such a manner that the union will be strong and invariable during the normal useful life of the tool, and which may be utilized equally well during the original manufacture of the the tool or while replacing the handle in the field.

Until recent years the only material used for handles in striking, cutting and/or prying tools such as hammers, sledges, peaveys, axes, etc., has been wood. For this reason, the method of attaching the handle to the tool head, whatever type it might have been, was dictated by the property characteristics of wood. It is generally recognized that, other than being strong enough to withstand handle abuse the tool would regularly take, there are two conditions which must be accommodated when inserting a wood handle into a tool head: to keep the tool head attached to the handle under all working conditions; and to maintain the head tight to the handle.

Traditionally, in percussive tools such as sledge hammers, the tool head includes an aperture or eyehole through its body which has a single or double taper. In both cases, the taper expands at the top of the tool head or that portion which is normally directed away from the user when the tool is in use. When a wooden handle is driven through the eyehole from the bottom side of the tool head, the excess wood protruding from the top side is cut off, and some wedging device, such as an ordinary wedge, is driven into the wood so that the upper end thereof is expanded to provide an inverted frustum which, theoretically, is tightly expanded into the tool eyehole. The expanded section of wood must fit within the upper tapered portion of the eyehole tightly so that the head cannot fly off during use. This is a very elemental assembly which has been in use for many years.

The use of wedges and the like to expand the upper section of the wood within the eyehole inherently involves damage to the handle which adversely affects many of the physical properties which are desired to be retained. Further, the wedges that are driven into the end of the wooden handle often tend to work loose, due most frequently to changes in humidity which cause alternate swelling and contraction of the wood with a gradual decrease in tightness. Many expedients have been employed in an attempt to overcome these faults, including the provision of metal sleeves to hold the tool handle in place, the use of adjustable wedges which must be periodically driven by the owner of the tool to compensate for loosening of the joint, the use of metal handles, the casting of wedges in position in the tool, and the provision of rubber sleeves interposed between the handle and the head. None of these aforementioned expedients have proven to be entirely satisfactory.

The primary reason why prior handles are typically inserted from the bottom and wedged at the top of the tool head is that there are very few tools which have an eyehole large enough to provide an opening through which the grip of the handle can pass. In prior handles, if the handle were small enough to pass through the eyehole, the grip would be much too small for a man to properly grasp it, and the wood would be too small to resist the abuse that the tool would take. Notably, there is one category of percussive tools that does not require the handle to be inserted from the bottom and then affixed within the eyehole as described above. This category includes the pick or pick-mattock style of tool in which the eyehole is so massive that even a large grip can be passed through the eyehole. Traditionally the handles for such pick or pick-mattock style tools are shaped so that the upper end has a reverse taper allowing the pick to be dropped over the grip onto the end farthest away from the user so that the expanded end of wood is large enough to lock the tool head in place and prevent it from ever sliding off the upper end. Of course, the tool head can always be removed in the same manner it is placed on the handle, by removing it from the butt or grip end.

Recent years have seen the development of extremely strong composite tool handles formed of reinforcing fibers cured within a resin composite. Such reinforcing fibers may include fiberglass, polyester, boron, kevlar or graphite, and suitable resin composites include polyester, epoxy, phenolics, etc. With the development of these composite materials, the shaft underneath the tool head can now be made with a cross-section small enough to pass through the conventional eyehole of percussive tool heads, and yet be strong enough to withstand the impact forces likely to be encountered.

As advanced materials have been introduced to replace wood, the materials have been either bonded into the eyehole of the tool, substituting the bond for the old traditional wedge, and/or welded such as metal to metal. Whereas these techniques are suitable to some degree for the manufacture of original tools in which the handle is installed with appropriate machinery and equipment at a factory, the techniques are not suitable when practiced in the field. In the case of bonding, composite shafts have been attached to tool heads primarily by means of adhesives in the epoxy field. When utilizing such adhesives, despite the continued development of these materials, it takes care, precision and good workmanship to properly install a replacement handle in a tool head reliably in the field with no secondary tools to assist. Even in factories where the tool head is installed on a production basis, high levels of quality control must be practiced in order to insure that the head is secured to the handle under all anticipated working conditions. Further, since the high strength composite shafts are usually inadequate in cross-sectional size to be comfortable for a user's hands, a grip of rubber or some other plastic material is usually molded onto the shaft or subsequently bonded thereto in a manner which guarantees that the grip will not accidentally slide off the shaft.

Accordingly, there has been a need for a highly reliable, simplified method by which a handle can be installed onto a tool head in which the handle is permitted to pass through the eyehole from the upper end in a manner which effectively prohibits the tool head from flying off the handle unintentionally. A handle for use in such method must include a minimum number of separate parts in order to greatly simplify assembly of the handle to the tool head, and also permit attachment of a grip which comfortably fits a user's hands. Further, an improved method of attaching a handle to a percussive tool is needed which facilitates use of reinforced composite tool handles as field replacements for older tools, which overcomes drawbacks associated with fixing such handles within the eyehole of the tool head solely by means of an epoxy. Moreover, an improved tool handle and method of attaching the handle to a percussive tool is needed which simplifies the manufacture and assembly of tools for both a field user and original equipment manufacturers. The present invention fulfills these needs and provides other related advantages.

SUMMARY OF THE INVENTION

The present invention resides in an improved replacement tool handle and method of attaching a handle to a tool head having an eyehole therethrough in such a manner that the union will be strong and invariable during the normal useful life of the tool, and which may be utilized equally well during the original manufacture of the tool or while replacing the handle in the field. The replacement tool handle comprises, generally, a load-bearing rod including a handle shaft capable of passing completely through the eyehole of the tool head, and means located at one end of the shaft for preventing an adjacent end of the rod from passing through the eyehole. Further, means are provided for engaging the tool head opposite the preventing means, to securely hold the tool head therebetween and minimize movement of the tool head relative to the rod.

In a preferred form of the invention, the preventing means includes a shaft retainer configured to engage a portion of the tool head defining the eyehole. The shaft retainer is dimensioned for partial insertion into the eyehole, and forms a generally frusto-conical slug having an outer surface portion generally corresponding to a portion of the eyehole, an enlarged portion which is incapable of passing through the eyehole, and an inner cavity having an opening opposite to the enlarged portion.

The engaging means includes a grip which is incapable of passing through the eyehole and which is positioned over a portion of the rod extending away from the tool head, and means for locking the grip with respect to the rod. The grip is slidably received onto a second end of the handle shaft for positioning a first end of the grip toward the tool head. The first end of the shaft is secured within the inner cavity of the shaft retainer.

The handle shaft is provided with a generally uniform cross-sectional dimension taken perpendicular to the longitudinal axis of the shaft. Said cross-sectional dimension corresponds with the cross-sectional dimension of the inner cavity of the shaft retainer taken perpendicular to the longitudinal axis of the shaft retainer.

Means for limiting rotation of the grip relative to the rod about the longitudinal axis of the shaft, are provided by configuring the second end of the shaft with a non-circular cross-section along its length taken perpendicular to its longitudinal axis. An internal cavity is provided the grip, for receiving and ensheathing the second end of the handle shaft. This internal cavity is provided with a matching non-circular cross-section along its length taken perpendicular to its longitudinal axis. Preferably, these cross-sections have an I-beam configuration.

The means for locking the grip with respect to the rod include co-linear apertures through the grip and the rod, and means inserted through the co-linear apertures for limiting movement of the grip relative to the rod. These means for limiting movement of the grip relative to the rod include two, oppositely facing, interlocking members situated within the co-linear apertures. Each interlocking member includes a plug portion and a tooth portion. The tooth portions engage one another within the outer periphery of the handle, and the plug portions block access to the tooth portions by a user to ensure a permanent connection. Further, each plug portion is provided with a runner which fits within a corresponding guide slot within the grip, to ensure proper orientation of the interlocking members.

Broadly, the method of attaching the replacement tool handle to a tool head having an eyehole therethrough, includes the steps of: (1) inserting a high strength rod through the eyehole of the tool head such that a first end of the rod engages at least a portion of the tool head defining the eyehole to prevent the rod from passing completely through the eyehole, and such that a portion of the rod extending to a second end thereof projects away from the tool head; (2) sliding a grip over the portion of the rod projecting away from the tool head, such that a first end of the grip having an outer dimension greater than the eyehole is situated adjacent to the tool head; and (3) attaching the grip to the portion of the rod projecting away from the tool head.

The replacement tool handle and related method may be utilized equally well during the original manufacture of the tool or while replacing the handle in the field. Provisions are made for limiting rotation of the rod relative to the tool head, and for limiting rotation of the grip relative to the rod. Once completely assembled, the replacement tool handle effectively prohibits the tool head from flying off the handle unintentionally, and the construction of the interlocking members with their connection within the handle itself, prevents the unintended separation of the grip from the rod.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a replacement tool handle embodying the invention and assembled to a sledge head;

FIG. 2 is an enlarged, exploded, perspective assembly view of the sledge hammer illustrated in FIG. 1, showing the manner in which the replacement tool handle is assembled to a percussive tool head;

DETAILED DESCRIPTION OF THE PREFERRED EMBODIMENT

Figure 3A:
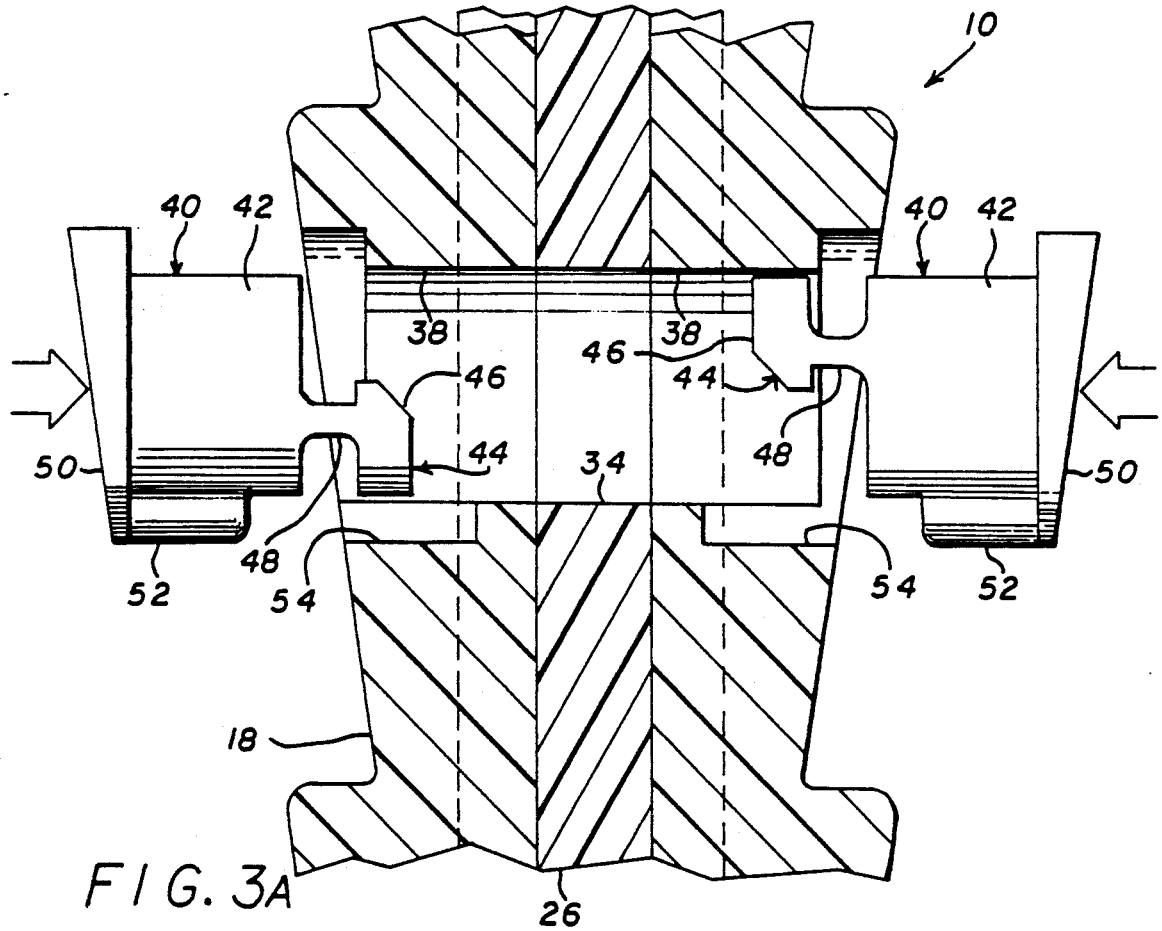
FIG. 3A is an enlarged, fragmented and partially sectional view taken generally along the line 3—3 of FIG. 1, illustrating an assembly step in fixing a grip to a handle shaft.

As shown in the drawings for purposes of illustration, the present invention is concerned with an improved replacement tool handle, generally designated in the accompanying drawings by the reference number 10. The improved replacement tool handle 10 comprises, generally, a high strength, load-bearing rod 12 having a portion thereof capable of passing through an eyehole 14 of a tool head 16, a grip 18 which is incapable of passing through the eyehole and is positioned over a portion of the rod 12, and means for locking the grip with respect to the rod.

Tool heads 16 which may be advantageously utilized in connection with the replacement tool handle 10 of the present invention typically comprise most of the broad range of percussive-type tool heads. Such tool heads typically include a body portion 20 and either a single-taper or double-tapered eyehole 14. In both instances, the eyehole 14 has a tapered portion which expands toward a top 22 of the tool head 16. The handle of the tool typically extends downwardly and away from a lower or bottom portion 24 of the tool head 16.

Figure 3B:
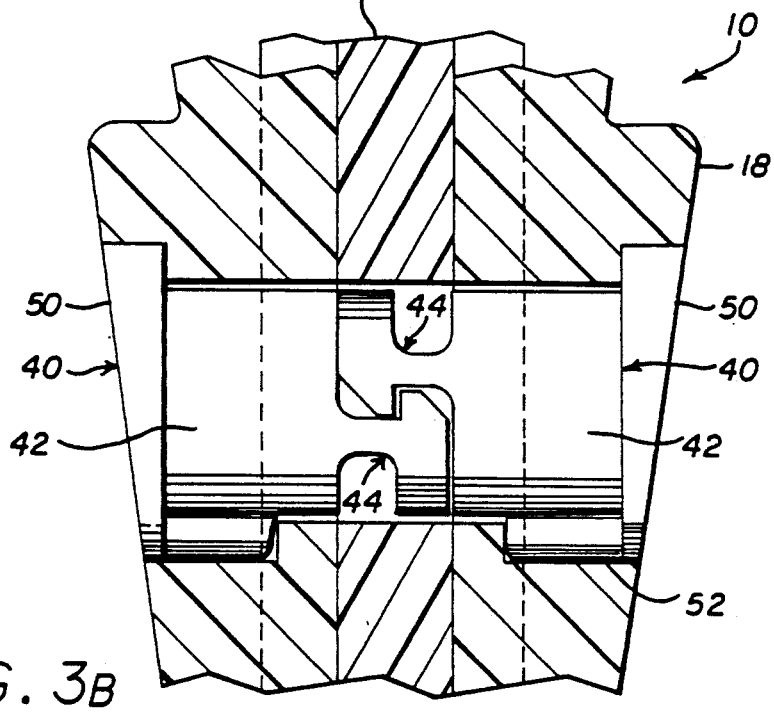
FIG. 3B is an enlarged, fragmented and partially sectional view similar to FIG. 3A, and also taken along the line 3—3 of FIG. 1, illustrating the manner in which two locking members interconnect within the replacement tool handle to lock the grip relative to the handle shaft.

In accordance with the present invention, and as illustrated in FIGS. 1 through 3, the load-bearing rod 12 includes a fiberglass-resin composite handle shaft 26 which is capable of passing completely through the eyehole 14, and a shaft retainer 28 located at a first end of the shaft for preventing an adjacent end of the rod 12 from passing through the eyehole 14. The shaft retainer 28 comprises a generally frusto-conical slug which is dimensioned for at least partial insertion into the eyehole 14 of the tool head 16. Preferably, the shaft retainer 28 is molded of a glass-reinforced nylon material for high strength and durability, but other materials are suitable for smaller or lighter weight tools. The shaft retainer 28 includes an outer surface portion 30 having a shape generally corresponding to a portion of the eyehole 14, an enlarged portion 32 which is incapable of passing through the eyehole, and an inner cavity (not shown) having an opening opposite to the enlarged portion.

The handle shaft 26 may be manufactured of any suitable material, including metal, but is preferably formed of a fiberglass-resin composite material. The handle shaft 26 is manufactured so that it has a uniform cross-sectional dimension taken generally perpendicular to its longitudinal axis, and is of sufficient length to extend substantially the entire intended length of the tool handle 10. A first end of the handle shaft 26 is secured within the inner cavity by any suitable means, such as by bonding with an epoxy compound. The handle shaft 26 is further preferably constructed to have an I-beam configuration which, as will be explained below, helps to prevent rotation of the various members of the replacement tool handle 10 relative to one another about the longitudinal axis of the tool handle. In this regard, the inner cavity of the shaft retainer 28 is provided a cross-sectional dimension which corresponds with the cross-sectional dimension of the handle shaft 26. The handle shaft 26 further includes an aperture 34 located through a second end portion thereof, which is exposed below the shaft retainer 28.

Since many eyeholes 14 found in the tool heads 16 of percussive tools are not perfectly circular in cross-section, rotation of the rod 12 relative to the tool head 16 may be limited and altogether prevented by providing the outer surface portion 30 of the shaft retainer 28 with a corresponding configuration. In the accompanying drawings, the eyehole and the outer surface portion 30 of the shaft retainer 28 each have an oval-shape configuration which acts to prevent rotation of the rod 12 relative to the tool head 16.

The grip 18 is preferably molded into a desirable shape from any material which is strong and yet comfortably handled by a user. The grip 18 primarily serves as a convenient surface by which the user can grasp the tool handle 10, as well as provide means for ensuring that the tool head 16 will not slide downwardly on the handle shaft 26. It does not provide the strength characteristics of the tool handle 10. Rather, the inherent strength of the tool handle 10 is provided by the rod 12.

The grip 18 includes an internal cavity 36 which is configured to receive and ensheathe the second end portion of the handle shaft 26. Means are provided for limiting rotation of the grip 18 relative to the rod 12 about the longitudinal axis of the shaft 26. This is accomplished by matching the cross-sectional dimension of the internal cavity 36 taken perpendicular to its longitudinal axis, with the non-circular cross-section of the handle shaft 26. As mentioned above, this configuration is preferably in the form of an I-beam. Co-linear apertures 38 are provided through opposite sides of the grip 18 and, when the grip 18 fully ensheathes the second portion of the handle shaft 26, these apertures 38 are aligned with the aperture 34 provided through the handle shaft 26.

Means are inserted through the co-linear apertures 38 and 34 for limiting movement of the grip 18 relative to the rod 12. This means for limiting movement includes two oppositely facing, interlocking members 40 which are inserted opposite to one another through the co-linear apertures 38 for engagement within the aperture 34 of the shaft retainer 28. Each interlocking member 40 includes a plug portion 42 and a tooth portion 44. Each tooth portion 44 includes a head 46 configured for directly engaging the head of the opposite interlocking member 40, and a neck portion 48, which permits some resilient movement of the head 46 in order to permit the interlocking members 40 to snap-fit together.

The plug portion 42 of each interlocking member 40 also may be provided with an outer shield 50 having an exterior surface designed to lie flush with the outer surface of the grip 18, and to block access to the tooth portions 44 of the interlocking members 40. This arrangement ensures that a permanent connection is made between the interlocking members 40, and thus there will be no movement between the grip 18 and the rod 12. Further, each plug portion 42 includes a runner 52 which fits within a corresponding guide slot 54 within the grip 18, to ensure proper orientation of the interlocking members.

Whether the tool handle 10 is being utilized by an original equipment manufacturer in a factory, or by a field user in re-handling a tool, the present invention provides a highly reliable, simplified method by which a handle can be installed onto most types of percussive tool heads, in a manner which effectively prohibits the tool head from flying off the handle unintentionally. In accordance with a preferred method of attaching the handle 10 to the tool head 16, a user first inserts the rod 12 through the eyehole 14 from the top side 22 of the tool head 16, such that a first end of the rod engages at least a portion of the tool head 16 defining the eyehole 14 to prevent the rod from passing completely through the eyehole. This is accomplished by means of the above-described shaft retainer 28 as the outer surface portion 30 thereof engages a portion of the tool head 16 surrounding the eyehole 14. The enlarged portion 32 of the shaft retainer 28 is incapable of passing through the eyehole 14. Inserting the rod as described permits a portion of the rod 12, comprising the handle shaft 26, to project away from the tool head 16 below the lower or bottom portion thereof 24. Since typical eyeholes 14 are non-circular in cross-section, by providing a shaft retainer 28 having a matching cross-sectional dimension, rotation of the rod 12 relative to the tool head 16 is limited.

With the rod 12 so positioned, the grip 18 is slid over the portion of the rod 12 projecting away from the tool head 16. More particularly, the portion of the handle shaft 26 extending downwardly from the tool head 16 is ensheathed within the internal cavity 36 of the grip 18, such that the upper end of the grip, which has an outer dimension greater than the eyehole 14, is situated adjacent to the tool head 16. This tends to position the tool head between the enlarged portion 32 of the shaft retainer 28, on the one hand, and the upper end of the grip 18, on the other. The upper end of the grip 18 will not necessarily abut the tool head, and yet perform satisfactorily. Since the internal cavity 36 of the grip 18 and the handle shaft 26 both have matching I-beam shaped cross-sectional configurations, rotation of the grip 18 relative to the rod 12 about the longitudinal axis of the handle 10 is virtually eliminated.

With the grip 18 so positioned, the apertures 38 and 34 become aligned with one another, and mechanical locking means, or the interlocking members 40, are inserted into the aligned co-linear apertures for locking the grip 18 onto the rod 12. The guide slots 54 provided in the grip 18 adjacent to the co-linear apertures 38, ensure that each interlocking member 40 is inserted correctly. Failure to align a runner 52 of the interlocking member 40 prevents insertion of the respective interlocking member 40 sufficiently to interconnect with the opposite interconnecting member.

From the foregoing it is to be appreciated that the present invention provides a highly reliable, simplified method by which a handle can be installed onto a percussive tool head, which effectively prohibits the tool head from flying off the handle unintentionally. The tool handle 10 of the present invention includes a minimum number of separate parts, which greatly simplifies assembly of the handle 10 to the tool head 16. Moreover, the grip 18 may be molded so that it will comfortably fit a user's hands. The tool handle 10 of the present invention facilitates use of reinforced composite tool handles as field replacements for older tools, and the present method overcomes drawbacks associated with fixing such handles within the eyehole of the tool head solely by means of an epoxy.

Although a particular embodiment of the invention has been described in detail for purposes of illustration, various modifications may be made without departing from the spirit and scope of the invention. Accordingly, the invention is not to be limited, except as by the appended claims.

I claim:

1. A replacement tool handle for a tool having a tool head including an eyehole, the tool handle comprising:

a high strength, load-bearing rod including a handle shaft capable of passing through the eyehole of the tool head, and means located at a first end of the shaft for preventing an adjacent end of the rod from passing through the eyehole;

a grip incapable of passing through the eyehole and positioned over a portion of the rod extending away from the tool head, the grip being slidably received onto a second end of the handle shaft for positioning a first end of the grip toward the tool head; and means for locking the grip with respect to the rod, the locking means including co-linear apertures through the grip and the rod, and means inserted through the co-linear apertures for limiting movement of the grip relative to the rod, the means for limiting movement of the grip relative to the rod including two oppositely facing, interlocking members situated within the co-linear apertures.

2. A replacement tool handle as set forth in claim 1, wherein the preventing means includes a shaft retainer configured to engage a portion of the tool head defining the eyehole.

3. A replacement tool handle as set forth in claim 2, wherein the shaft retainer is dimensioned for partial insertion into the eyehole, and forms a generally frustoconical slug having an outer surface portion generally corresponding to a portion of the eyehole, and an enlarged portion which is incapable of passing through the eyehole.

4. A replacement tool handle as set forth in claim 3, wherein the shaft retainer includes an inner cavity having an opening opposite to the enlarged portion, and wherein the first end of the shaft is secured within the inner cavity.

5. A replacement tool handle as set forth in claim 4, wherein the first end of the shaft is provided with a generally uniform cross-sectional dimension taken perpendicular to the longitudinal axis of the shaft, and wherein said cross-sectional dimension corresponds with the cross-sectional dimension of the inner cavity taken perpendicular to the longitudinal axis of the shaft retainer.

6. A replacement tool handle as set forth in claim 1, wherein the grip includes an internal cavity for receiving and ensheathing the second end of the handle shaft.

7. A replacement tool handle as set forth in claim 6, including means for limiting rotation of the grip relative to the rod about the longitudinal axis of the shaft.

8. A replacement tool handle as set forth in claim 7, wherein the rotation limiting means includes the providing of the second end of the shaft with a non-circular cross-section along its length taken perpendicular to its longitudinal axis, and providing the internal cavity of the grip with a matching non-circular cross-section along its length taken perpendicular to its longitudinal axis.

9. A replacement tool handle as set forth in claim 8, wherein the cross-section of the second end of the shaft has an I-beam configuration.

10. A replacement tool handle as set forth in claim 1, wherein each interlocking member includes a plug portion and a tooth portion, wherein the tooth portions engage one another within the outer periphery of the handle, and the plug portions block access to the tooth portions by a user to ensure a permanent connection.

11. A replacement tool handle as set forth in claim 10, wherein each plug portion includes a runner which fits within a corresponding guide slot within the grip, to ensure proper orientation of the interlocking members.

12. A hand tool, comprising:

a tool head having a body and an eyehole through the body;

a load-bearing rod including a shaft portion capable of passing through the eyehole of the tool head, and means located at one end of the shaft portion for preventing an end of the rod from passing through the eyehole;

means for engaging the rod opposite the preventing means relative to the tool head, to position the tool head therebetween, the engaging means including a grip capable of passing through the eyehole and positioned over a portion of the rod extending away from the tool head, the grip being slidably received onto a second end of the shaft portion for positioning a first end of the grip toward the tool head; and means for locking the grip with respect to the rod, the locking means including co-linear apertures through the grip and the rod, and means inserted through the co-linear apertures for limiting movement of the grip relative to the rod, wherein the means for limiting movement of the grip relative to the rod includes two oppositely facing, interlocking members situated within the co-linear apertures.

13. A hand tool as set forth in claim 12, wherein the preventing means includes a shaft retainer configured to engage a portion of the tool head defining the eyehole.

14. A hand tool as set forth in claim 13, wherein the shaft retainer is dimension for partial insertion into the eyehole, and forms a generally frusto-conical slug having an outer surface portion generally corresponding to a portion of the eyehole, an enlarged portion which is incapable of passing through the eyehole, and an inner cavity having an opening opposite to the enlarged portion, wherein the first end of the shaft is secured within the inner cavity.

15. A hand tool as set forth in claim 14, wherein the first end of the shaft is provided with a generally uniform cross-sectional dimension taken perpendicular to the longitudinal axis of the shaft, and wherein said cross-sectional dimension corresponds with the cross-sectional dimension of the inner cavity taken perpendicular to the longitudinal axis of the shaft retainer 16. A hand tool as set forth in claim 12, including means for limiting rotation of the grip relative to the rod about the longitudinal axis of the shaft, the rotation limiting means including the provision of the second end of the shaft with a non-circular cross-section along its length taken perpendicular to its longitudinal axis, and the provision of an internal cavity within the grip with a matching non-circular cross-section along its length taken perpendicular to its longitudinal axis, wherein the cross-section of the second end of the shaft has an I-beam configuration, and wherein the internal cavity of the grip receives and ensheathes the second end of the handle shaft.

17. A hand tool as set forth in claim 12, wherein each interlocking member includes a plug portion and a tooth portion, wherein the tooth portions engage one another within the outer periphery of the handle, and the plug portions block access to the tooth portions by a user to ensure a permanent connection.

18. A replacement tool handle for a percussive tool having a tool head including an eyehole, the tool handle comprising:

a high strength, load-bearing rod including a handle shaft capable of passing through the eyehole of the tool head, and means located at a first end of the shaft for preventing an adjacent end of the rod from passing through the eyehole, wherein the preventing means includes a shaft retainer configured to engage a portion of the tool head defining the eyehole, the shaft retainer being dimensioned for partial insertion into the eyehole and forming a generally frusto-conical slug having an outer surface portion generally corresponding to a portion of the eyehole, an enlarged portion which is incapable of passing through the eyehole, and an inner cavity having an opening opposite to the enlarged portion, wherein the first end of the shaft is secured within the inner cavity, and wherein the first end of the shaft is provided with a generally uniform cross-sectional dimension taken perpendicular to the longitudinal axis of the shaft, and wherein said cross-sectional dimension corresponds with the cross-sectional dimension of the inner cavity taken perpendicular to the longitudinal axis of the shaft retainer;

a grip incapable of passing through the eyehole and positioned over a portion of the rod extending away from the tool head, the grip being slidably received onto a second end of the handle shaft for positioning a first end of the grip adjacent to the tool head, wherein the grip includes an internal cavity for receiving and ensheathing the second end of the handle shaft;

means for limiting rotation of the grip relative to the rod about the longitudinal axis of the shaft, the rotation limiting means including the provision of the second end of the shaft with a non-circular cross-section along its length taken perpendicular to its longitudinal axis, and the provision of the internal cavity of the grip with a matching non-circular cross-section along its length taken perpendicular to its longitudinal axis, wherein the cross-section of the second end of the shaft has an I-beam configuration; and means for locking the grip with respect to the rod, wherein the locking means includes co-linear apertures through the grip and the rod, and two oppositely facing, interlocking members positioned within the co-linear apertures for limiting movement of the grip relative to the rod, wherein each interlocking member includes a plug portion and a tooth portion, wherein the tooth portions engage one another within the outer periphery of the handle, and the plug portions block access to the tooth portions by a user to insure a permanent connection.

19. A method of attaching a handle to a tool head having an eyehole therethrough, the steps comprising:

inserting a high strength rod through the eyehole of the tool head such that a first end of the rod engages at least a portion of the tool head defining the eyehole to prevent the rod from passing completely through the eyehole, and such that a portion of the rod extending to a second end thereof projects away from the tool head;

sliding a grip over the portion of the rod projecting away from the tool head, such that a first end of the grip having an outer dimension greater than the eyehole is situated adjacent to the tool head; and attaching the grip of the portion of the rod projecting away from the tool head, wherein the step of attaching the grip includes the steps of aligning co-linear apertures through the grip and the portion of the rod projecting away from the tool head, and inserting mechanical locking means into the aligned co-linear apertures.

20. A method of attaching a handle to a tool head as set forth in claim 19, wherein the step of inserting a high strength rod through the eyehole of the tool head includes the step of mating a tapered portion of the eyehole with a similarly tapered portion of the rod at its first end, wherein the extreme first end of the rod is enlarged sufficiently to as to be incapable of passing through the eyehole.

21. A method of attaching a handle to a tool head as set forth in claim 20, including the step of limiting rotation of the rod relative to the tool head.

22. A method of attaching a handle to a tool head as set forth in claim 21, wherein the step of limiting rotation of the rod includes the provision of a rod wherein the tapered first end is non-circular in cross-section taken perpendicular to the longitudinal axis of the rod.

23. A method of attaching a handle to a tool head as set forth in claim 19, wherein the step of sliding a grip over the portion of the rod projecting away from the tool head includes the step of ensheathing said portion of the rod.

24. A method of attaching a handle to a tool head as set forth in claim 23, including the step of limiting rotation of the grip relative to the rod.

25. A method of attaching a handle to a tool head as set forth in claim 24, wherein the step of limiting rotation of the grip relative to the rod includes the provision of the portion of the rod projecting away from the tool head with a non-circular cross-section along its length taken perpendicular to its longitudinal axis, and the provision of a cavity within the grip having a matching non-circular cross-section along its length taken perpendicular to its longitudinal axis.

26. A method of attaching a handle to a tool head as set forth in claim 19, wherein the step of inserting mechanical locking means includes the insertion of two oppositely facing, interlocking members from opposite sides of the aligned co-linear apertures, for interlocking with one another within the outer periphery of the handle.

27. A method of attaching a handle to a tool head having an eyehole therethrough, the steps comprising:

inserting a high strength rod through the eyehole of the tool head such that a first end of the rod engages at least a portion of the tool head defining the eyehole to prevent the rod from passing completely through the eyehole, and such that a portion of the rod extending to a second end thereof projects away from the tool head, wherein the step of inserting a high strength rod through the eyehole of the tool head further includes the step of mating a tapered portion of the eyehole with a similarly tapered portion of the rod at its first end, wherein the extreme first end of the rod is enlarged sufficiently so as to be incapable of passing through the eyehole;

limiting rotation of the rod relative to the tool head, wherein the step of limiting rotation of the rod includes the provision of a rod wherein the tapered first end is non-circular in cross-section taken perpendicular to the longitudinal axis of the rod;

sliding a grip over the portion of the rod projecting away from the tool head, such that a first end of the grip having an outer dimension greater than the eyehole is situated adjacent to the tool head, wherein said sliding step includes the step of ensheathing said portion of the rod;

limiting rotation of the grip relative to the rod by providing the portion of the rod projecting away from the tool head with a non-circular cross-section along its length taken perpendicular to its longitudinal axis, and by providing a cavity within the grip having a matching non-circular cross-section along its length taken perpendicular to its longitudinal axis; and attaching the grip to the portion of the rod projecting away from the tool head, said attaching step including the steps of aligning co-linear apertures through the grip and the portion of the rod projecting away from the tool head, and inserting mechanical locking means into the aligned co-linear apertures, wherein the step of inserting mechanical locking means includes the insertion of two oppositely facing, interlocking members from opposite sides of the aligned co-linear apertures, for interlocking with one another within the outer periphery of the handle.

* * * * *